US010961042B1

(12) United States Patent
Nganga

(10) Patent No.: US 10,961,042 B1
(45) Date of Patent: Mar. 30, 2021

(54) LAUNDRY DETERGENT POD DISPENSING CONTAINER

(71) Applicant: Julius K. Nganga, Las Vegas, NV (US)

(72) Inventor: Julius K. Nganga, Las Vegas, NV (US)

( * ) Notice: Subject to any disclaimer, the term of this patent is extended or adjusted under 35 U.S.C. 154(b) by 0 days.

(21) Appl. No.: 16/600,886

(22) Filed: Oct. 14, 2019

(51) Int. Cl.
*B65D 83/04* (2006.01)

(52) U.S. Cl.
CPC ..... *B65D 83/0409* (2013.01)

(58) Field of Classification Search
CPC .... B65D 83/049; B65D 83/0409; G07F 11/24
See application file for complete search history.

(56) References Cited

U.S. PATENT DOCUMENTS 2,718,088 A * 9/1955 Perry ..... A01K 97/04 43/55
2,729,366 A * 1/1956 Chadwick ..... B65D 83/0409 222/362
3,567,076 A * 3/1971 Zanussi ..... D06F 33/06 222/144
3,760,985 A 9/1973 Bryan
4,032,050 A 6/1977 Funk
4,273,254 A * 6/1981 Cuppleditch ..... B65D 83/0409 221/196
4,613,057 A * 9/1986 Sacchetti ..... B65D 83/0409 221/265
4,817,955 A * 4/1989 Hickson ..... A63B 47/002 124/51.1
5,074,434 A * 12/1991 Maki ..... G07D 9/008 221/173
5,176,290 A * 1/1993 Schwarzli ..... G07F 11/24 221/200
5,549,217 A * 8/1996 Benarrouch ..... B65D 83/0409 221/155

(Continued)

FOREIGN PATENT DOCUMENTS

WO WO2017037675 A1 3/2017

OTHER PUBLICATIONS

"Coin Operated Coffee Pod Dispenser", https://www.amazon.com/Mind-Reader-Capacity-Revolution-Dispenser/dp/B00YEMSMIM.

*Primary Examiner* — Gene O Crawford
*Assistant Examiner* — Kelvin L Randall, Jr.

(57) ABSTRACT

A laundry detergent pod dispensing container includes a container, a connector plate, a dispensing mechanism, and a locking mechanism. The dispensing mechanism includes a top rotor assembly, a central rod, a fluctuating plate, a plurality of springs, and a bottom rotor plate. The central rod concentrically traverses through the connector plate as the top rotor assembly and the bottom rotor plate are terminally attached to the central rod. The fluctuating plate is concentrically connected to the connector plate by the plurality of springs and positioned in between the top rotor assembly and the connector plate. The locking mechanism is integrated between the top rotor assembly and the fluctuating plate. The locking mechanism enables rotation of the bottom rotor plate that selects and dispenses the laundry detergent pods. The connector plate is circumferencely attached to a rim of the container thus secularly storing the laundry detergent pods within the container.

14 Claims, 11 Drawing Sheets

(56) References Cited

U.S. PATENT DOCUMENTS

| | | | | |
|---|---|---|---|---|
| 5,791,515 | A * | 8/1998 | Khan | B65D 83/0409 206/533 |
| 6,299,019 | B1 * | 10/2001 | Leight | A61F 15/001 221/186 |
| 7,097,068 | B2 * | 8/2006 | Limback | A47L 15/4409 221/2 |
| 10,118,188 | B2 * | 11/2018 | Wang | B05B 7/145 |
| 10,482,703 | B2 * | 11/2019 | Rudek | A61F 15/001 |
| 2004/0200357 | A1 * | 10/2004 | Wang | A47J 31/3609 99/279 |
| 2010/0006123 | A1 | 1/2010 | Simpson et al. | |
| 2012/0145740 | A1 * | 6/2012 | Chu | B65D 83/0409 221/277 |
| 2017/0057730 | A1 * | 3/2017 | Wang | G01F 13/001 |
| 2017/0259986 | A1 * | 9/2017 | Sanders | B65D 83/0409 |
| 2019/0114866 | A1 * | 4/2019 | Yoshida | G07F 11/54 |

* cited by examiner

LAUNDRY DETERGENT POD DISPENSING CONTAINER

FIELD OF THE INVENTION

The present invention relates generally to a childproof storage container. More specifically, the present invention is a childproof storage container that individually dispense laundry detergent pods.

BACKGROUND OF THE INVENTION

Laundry detergent pods or packs are water-soluble pouches containing highly concentrated laundry detergent, softener, and other laundry products. The chemistry of laundry detergent packs is generally smiler to traditional liquid detergents. The dissolvable packets is typically made of polyvinyl alcohol (PVA) or a derivative of PVA. Laundry detergent pods were advertised as a way to reduce wasted use of powdered and liquid detergent by having precise measurements for a load. Additionally, laundry detergent pods are steadily becoming popular among consumers due to their individually packaging which reduces wastage. However, concern has been raised over children accidentally being exposed to laundry detergent packs, as its appearance and the packaging design can have the same appeal to a child as hard candy with patterned designs and be confused as such. Even though manufacturers have move towards safe packaging, re-focusing safe advertisements, improvements for storage containers, and less enticing appearance, injuries from laundry detergent pods have been increasing over the years. Furthermore, emergence of a viral Internet trend, called the "Tide Pod Challenge", which participants intentionally ingest laundry detergent pods, have also injured children and teens in recent years. Due to these hazards' incidents, there is a need for more advance and safe laundry detergent pod storage container.

It is there an objective of the present invention to provide a childproof laundry detergent pod dispensing storage container so that the manufacturers and/or consumers can safely store the laundry detergent pods. More specifically, the present invention enables the storage of the laundry detergent pods within a container as a connector plate and a locking mechanism restrict the dispensing of the laundry detergent pods. Each of the laundry detergent pods can be individually dispensed from the present invention as the locking mechanism selectively enables the operation of a dispensing mechanism of the present invention.

DETAIL DESCRIPTIONS OF THE INVENTION

All illustrations of the drawings are for the purpose of describing selected versions of the present invention and are not intended to limit the scope of the present invention.

The present invention is a childproof laundry detergent pod dispensing storage container 1 so that the manufacturers and/or consumers can safely store laundry detergent pods. More specifically, a locked position of the present invention is able to completely restrict access to the laundry detergent pods at a single instant. However, an unlocked position of the present invention is able to individually dispense the laundry detergent thus limiting access to multiple detergent pods at a single instant.

Figure 1:
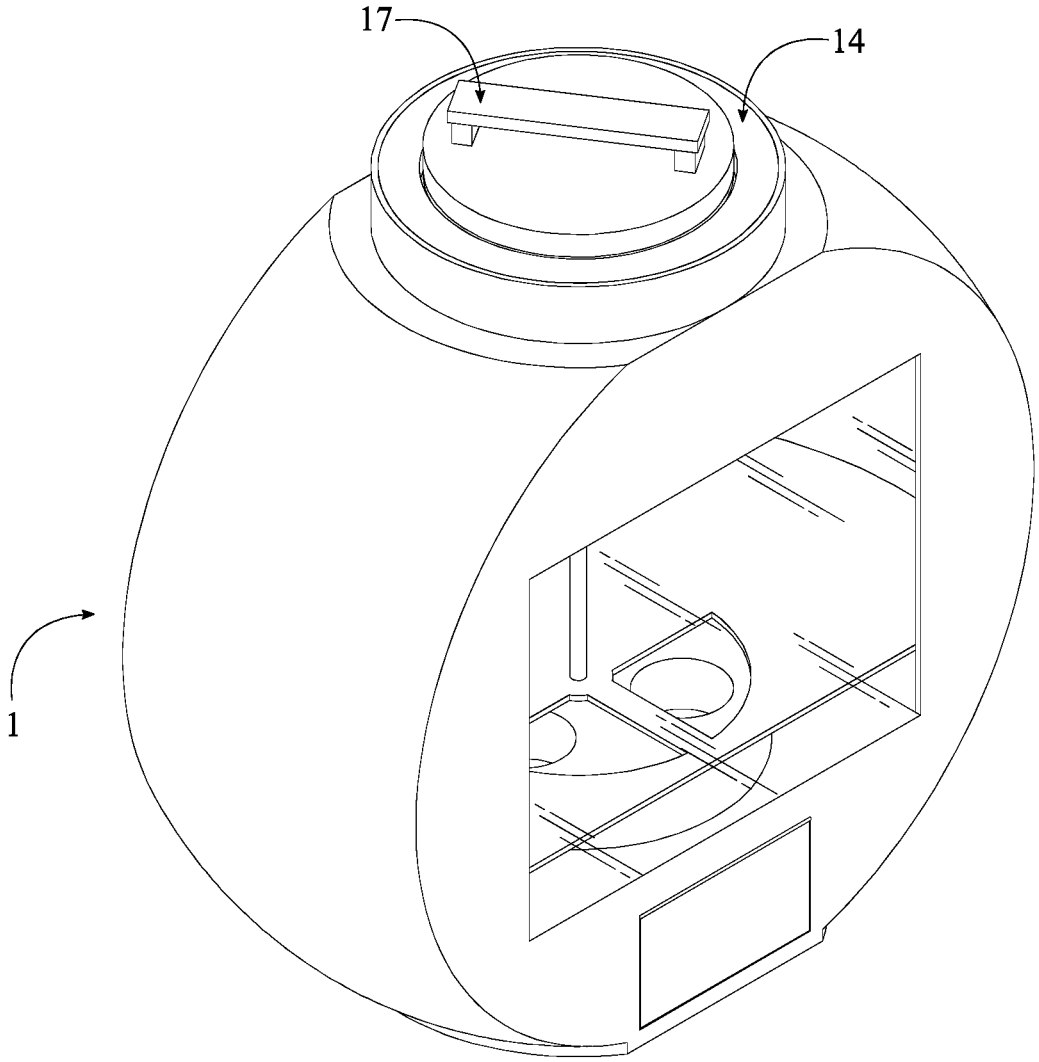
FIG. 1 is a perspective view of the present invention.
Figure 2:
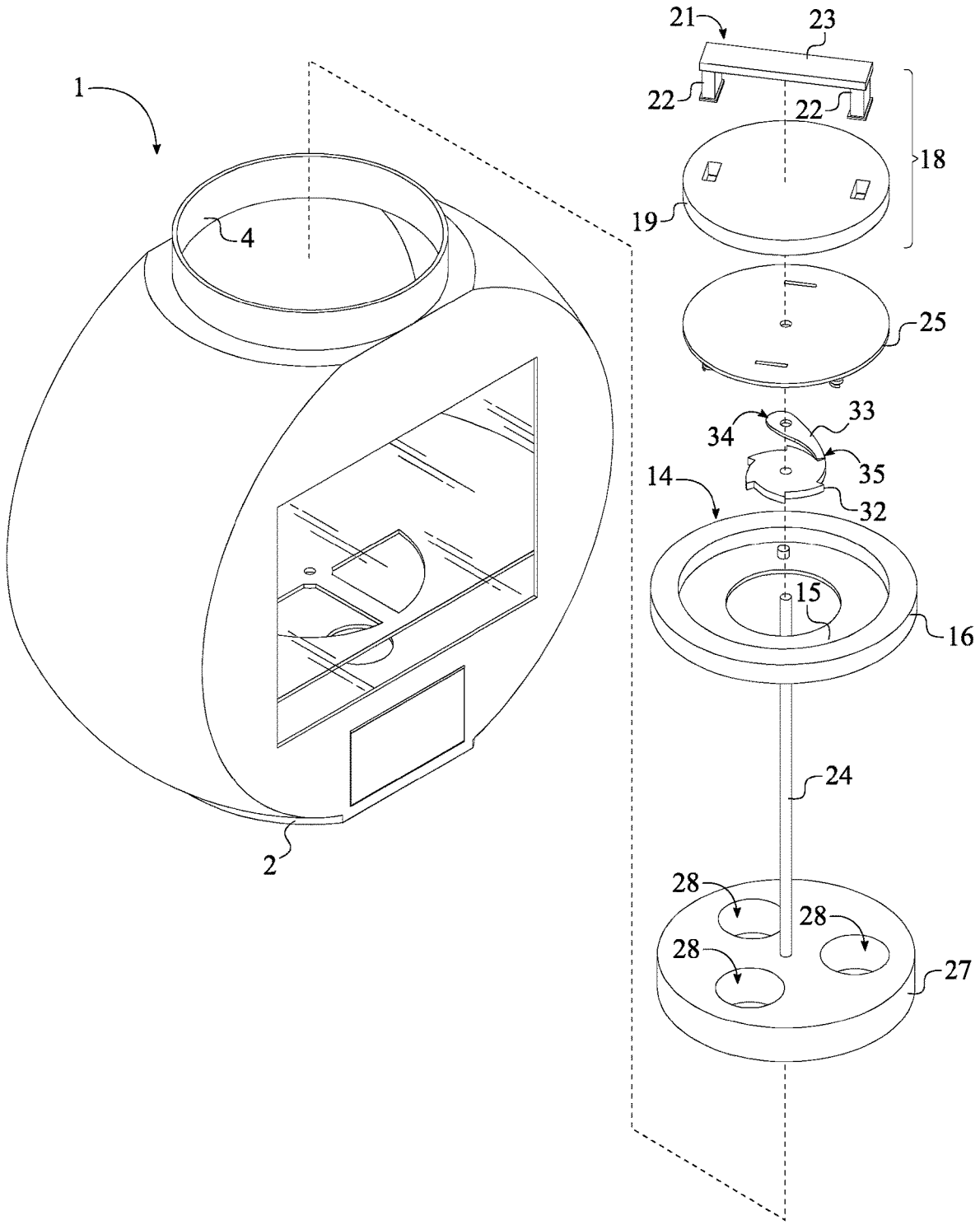
FIG. 2 is a top exploded view of the present invention.
Figure 3:
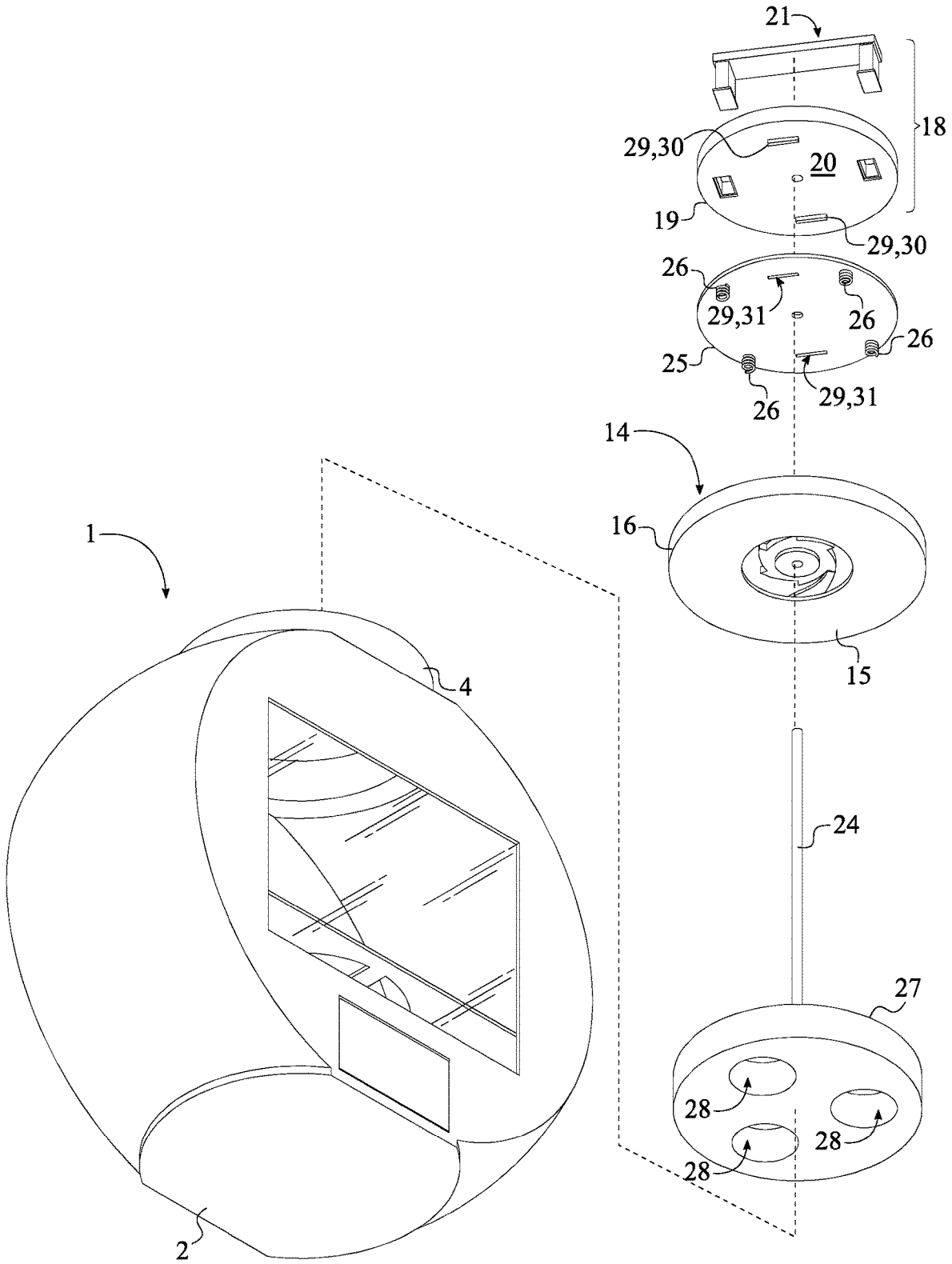
FIG. 3 is a bottom exploded view of the present invention.
Figure 4:
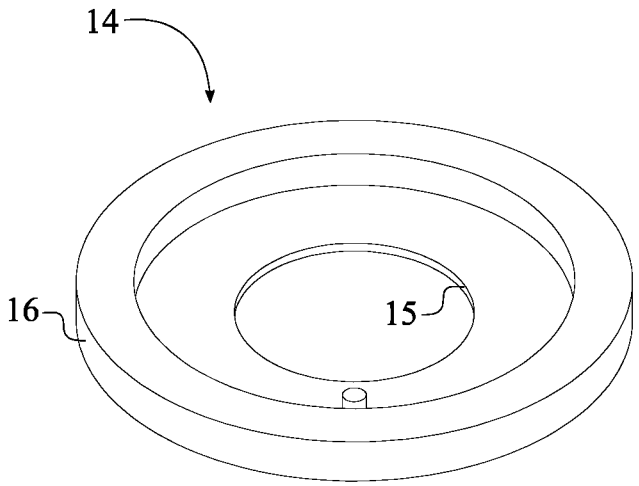
FIG. 4 is a perspective view of the connector plate of the present invention.

The present invention comprises a container 1, a connector plate 14, a dispensing mechanism 17, and a locking mechanism 29 as shown in FIG. 1-3. The dispensing mechanism 17 that enables the dispensing process of the laundry detergent pods comprises a top rotor assembly 18, a central rod 24, a fluctuating plate 25, a plurality of springs 26, and a bottom rotor plate 27. More specifically, the connector plate 14 is circumferencely attached to a rim 4 of the container 1 as the connector plate 14 functions as the lid for the container 1. The central rod 24 concentrically traverses through the connector plate 14 so that the top rotor assembly 18 can be terminally attached to the central rod 24 as the top rotor assembly 18 is positioned adjacent to connector plate 14. The fluctuating plate 25 is concentrically connected to the connector plate 14 by the plurality of springs 26 as the fluctuating plate 25 being positioned in between the top rotor assembly 18 and the connector plate 14. The locking mechanism 29 is integrated between the top rotor assembly 18 and the fluctuating plate 25 so that the locking mechanism 29 can selectively rotate or lock the top rotor assembly 18 about the fluctuating plate 25. The bottom rotor plate 27 is terminally connected to the central rod 24 and positioned opposite of the top rotor assembly 18 and adjacent to a base 2 of the container 1. The bottom rotor plate 27 is able to individually pick and dispense a single laundry detergent pod when the present invention is configured at the unlocked position.

The connector plate 14 enables access to a storage compartment 5 of the container 1 so that the laundry detergent pods can be stored within the storage compartment 5. In reference to FIG. 1-4, the connector plate 14 comprises an annular base 15 and a lateral wall 16. More specifically, the lateral wall 16 of the connector plate 14 is perimetrically connected around the annular base 15 so that the lateral wall 16 of the connector plate 14 can circumferencely attach to the rim 4 of the container 1. The lateral wall 16 of the connector plate 14 can be internally or externally attached to the rim 4 thus utilizing existing fastening mechanism such as pressure fit, male and female threads, and snap fit. The annular base 15 is encircled around the central rod 24 so that the central rod 24 can freely rotate within the present invention. Furthermore, the connector plate 14 comprises a child-resistant locking closure so that the connector plate 14 cannot be easily removed from the container 1 by children.

The top rotor assembly 18 functions as the upper most body of the dispensing mechanism 17 as the top rotor assembly 18 is configured to receive rotational movement from the user. In reference to FIG. 1-3, the top rotor assembly 18 comprises a plate body 19 and a handle 21. The plate body 19 is concentrically positioned within the lateral wall 16 of the connector plate 14 so that the plate body 19 does not interfere with the attachment between the lateral wall 16 of the connector plate 14 and the rim 4. The central rod 24 is concentrically attached to the plate body 19 so that the central rod 24 is able to transfer the applied rotational movement to the bottom rotor plate 27. The handle 21 allows the user to configure the locking mechanism 29 into the unlocked position and rotate the top rotor assembly 18 about the central rod 24. More specifically, at least one arm 22 of the handle 21 slidably traverses through the plate body 19 while a main body 23 of the handle 21 is positioned external to the plate body 19. In order to press down on the fluctuating plate 25, the main body 23 and the central rod 24 are oppositely positioned of each other about the plate body 19. When the user presses down on the main body 23, the at least one arm 22 slides through the plate body 19 and applies downward pressure on the fluctuating plate 25. Resultantly, the at least one arm 22 downwardly moves the fluctuating plate 25 thus converting the locking mechanism 29 from the locked position to the unlocked position. The user can then rotate the top rotor assembly 18 through the main body 23 while continuously applying the pressure on the main body 23.

The plurality of spring is able to applies spring force to the fluctuating plate 25 so that the locking mechanism 29 can convert from the unlocked position to the locked position once the user releases the main body 23. In reference to FIG. 3, FIG. 8, and FIG. 11, the plurality of springs 26 is compressionally positioned in between the fluctuating plate 25 and the annular base 15 so that the plurality of springs 26 can be terminally connected to the fluctuating plate 25 and the annular base 15. In order to maintain a flat surface area while the fluctuating plate 25 is pressed down through the at least one arm 22, the plurality of springs 26 is radially positioned around the central rod 24 so that the applied pressure can be evenly distributed around the fluctuating plate 25.

In order to convert from the locked position to the unlocked position and vice versa, the locking mechanism 29 comprises a pair of extension legs 30 and a pair of openings 31 as shown in FIG. 3. More specifically, the pair of extension legs 30 is terminally connected to the plate body 19. Preferably, each leg of the pair of extension legs 30 is diametrically opposed of each other. The pair of extension legs 30 is oriented toward the fluctuating plate 25 as the pair of openings 31 traverses through the fluctuating plate 25. Furthermore, a cross sectional profile of the pair of extension legs 30 matches to a cross sectional profile of the pair of openings 31 so that the pair of extension legs 30 can be easily engaged or disengaged from the pair of openings 31.

Figure 6:
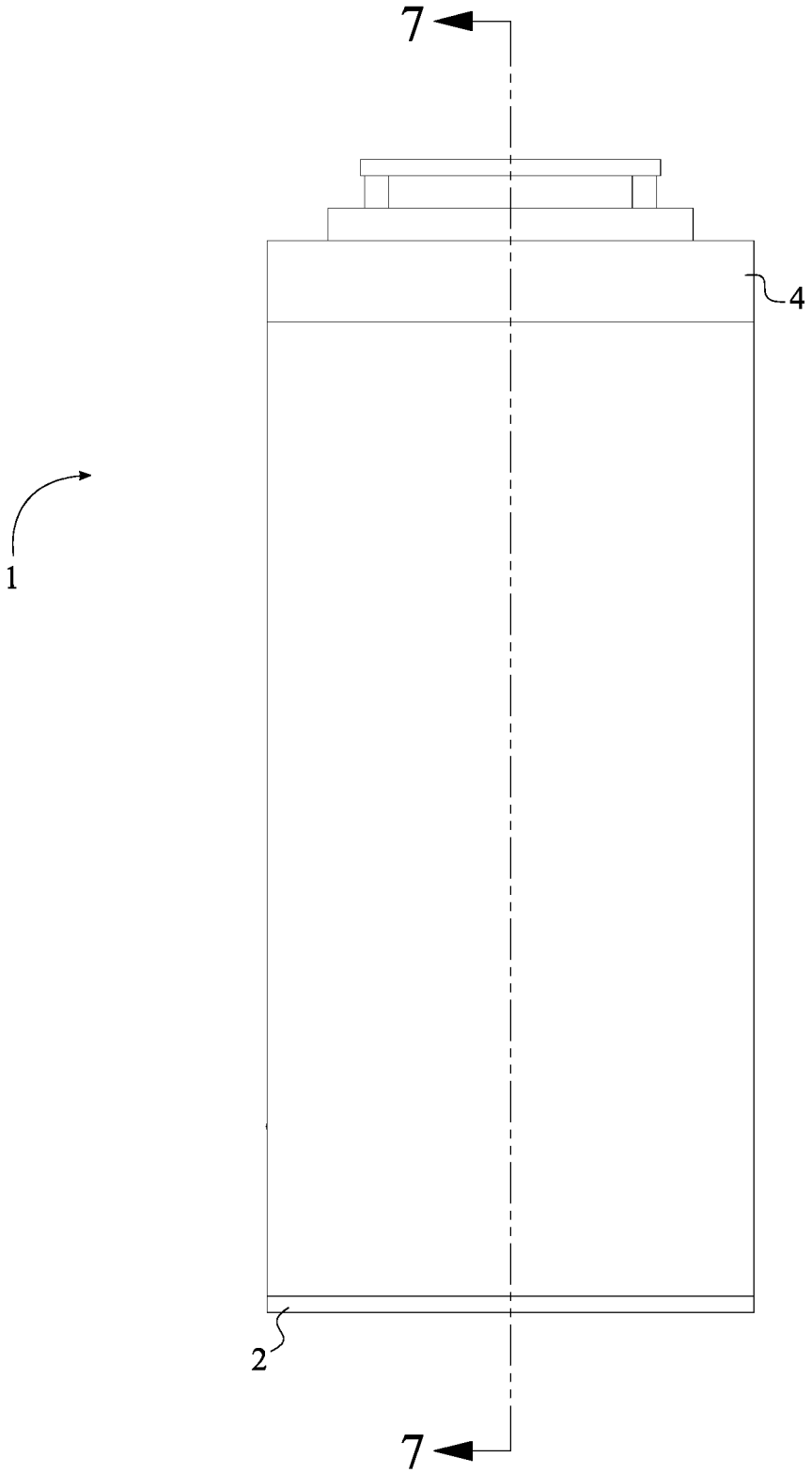
FIG. 6 is a side view of the present invention, showing the plane upon a cross sectional view is taken shown in FIG. 7.
Figure 7:
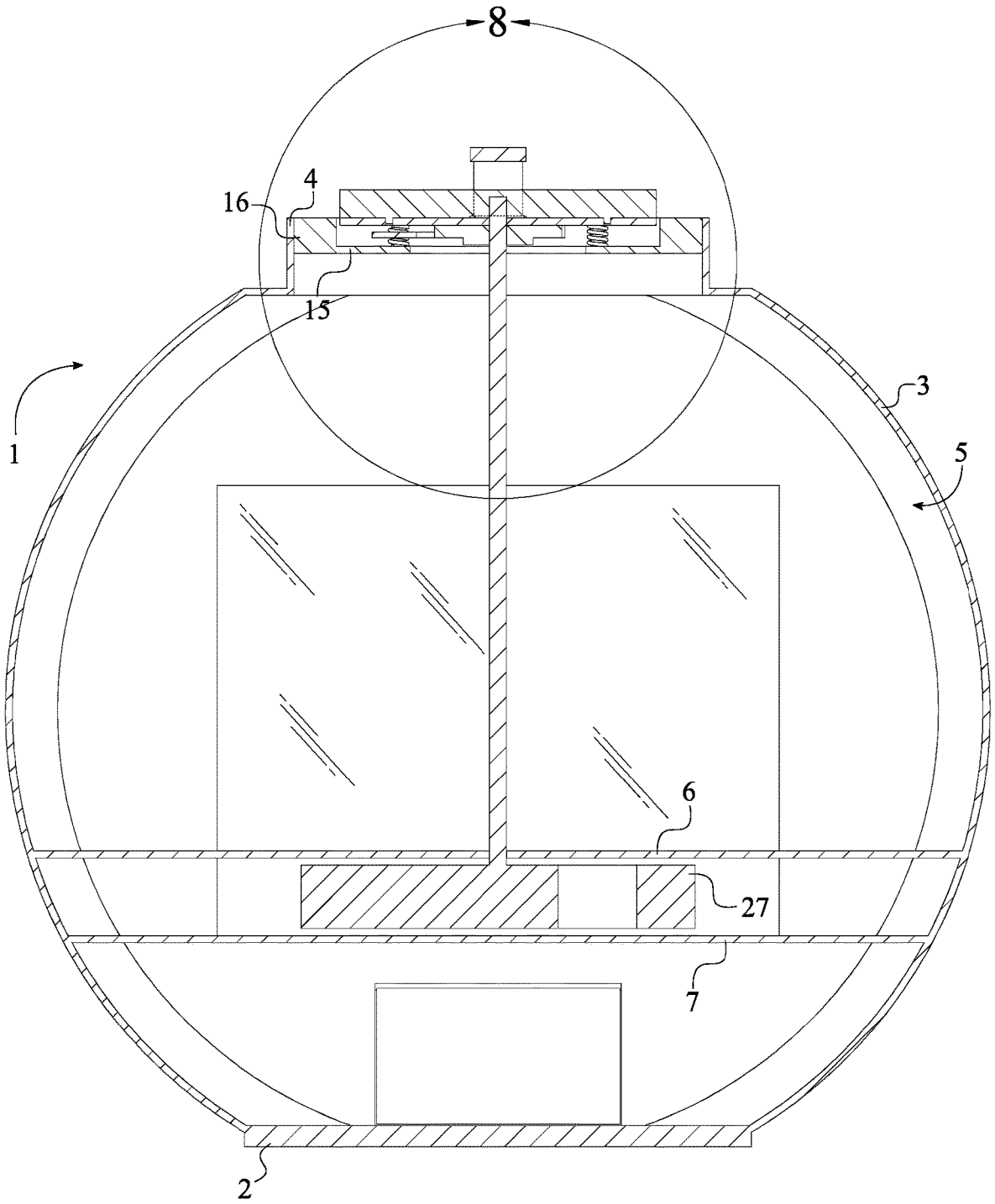
FIG. 7 is a cross sectional view of the present invention taken along line 7-7 of the FIG. 6 and showing the section, which a detailed view is taken shown in FIG. 8.
Figure 8:
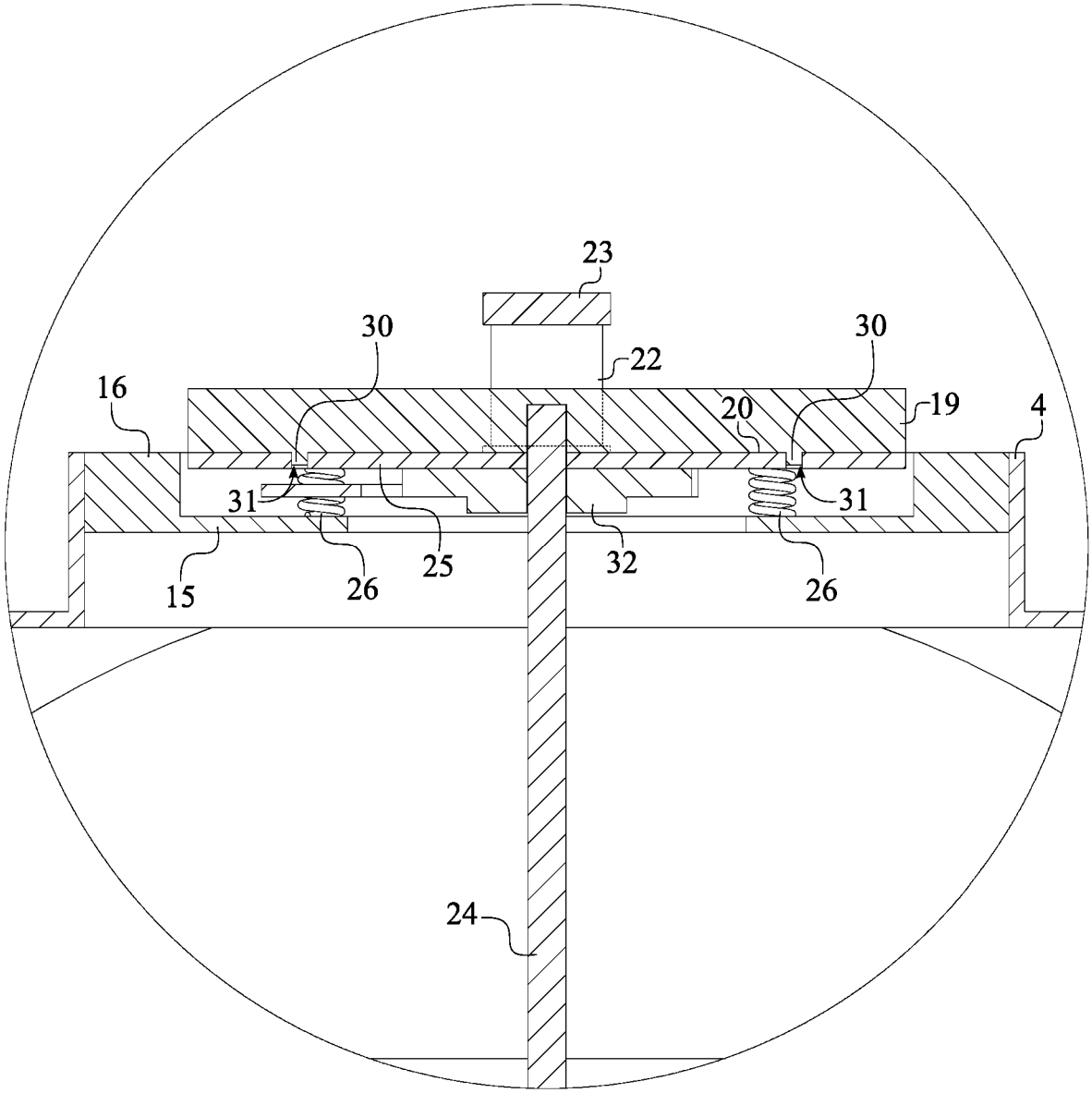
FIG. 8 is a detailed sectional view of the present invention, showing the locked position of the locking mechanism.

When the dispensing mechanism 17 is positioned stationary about the container 1, the locking mechanism 29 is selectively configured into the locked position as shown in FIG. 6-8. In reference to the locked position, the at least one arm 22 of the handle 21 is positioned flush to a bottom surface 20 of the plate body 19 as the plate body 19 is positioned adjacent to the fluctuating plate 25. The pair of extension legs 30 is engaged within the pair of openings 31 as the spring force of the plurality of springs 26 presses the fluctuating plate 25 against the bottom surface 20 of the plate body 19. As a result, the user is not able to rotate the top rotor assembly 18 due to the engagement between the pair of extension legs 30 and the pair of openings 31.

Figure 9:
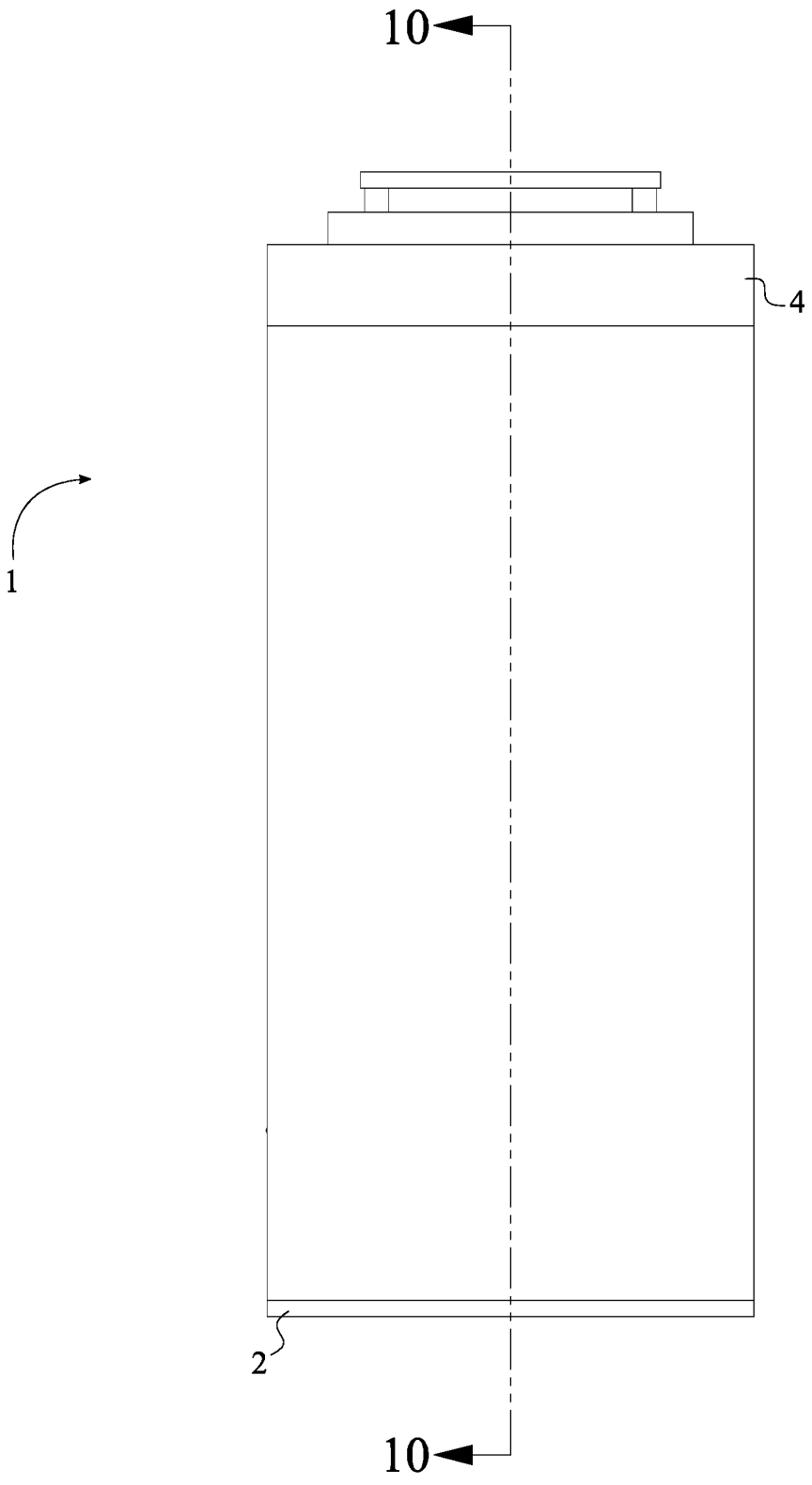
FIG. 9 is a side view of the present invention, showing the plane upon a cross sectional view is taken shown in FIG. 10.
Figure 10:
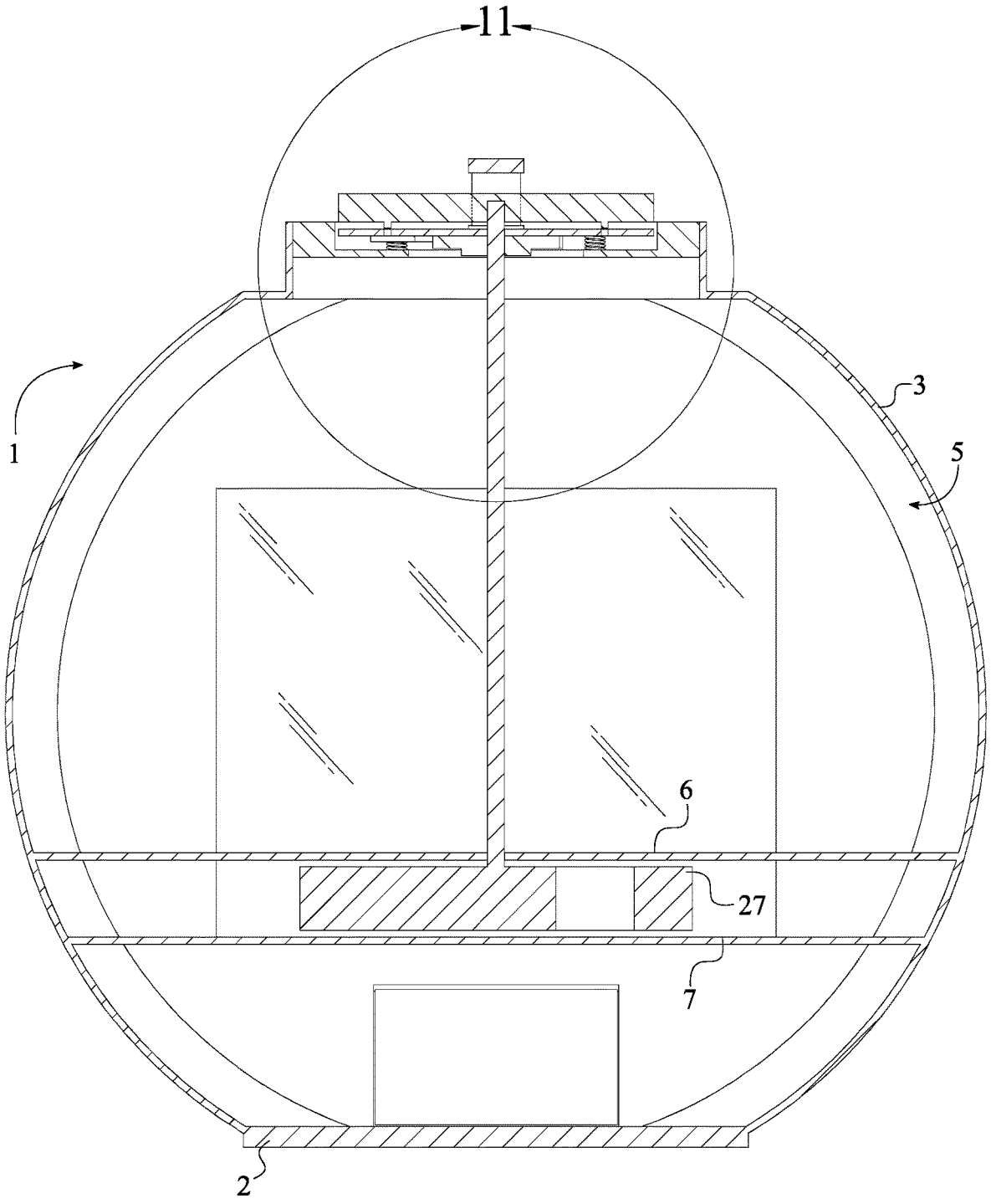
FIG. 10 is a cross sectional view of the present invention taken along line 10-10 of the FIG. 9 and showing the section, which a detailed view is taken shown in FIG. 11.
Figure 11:
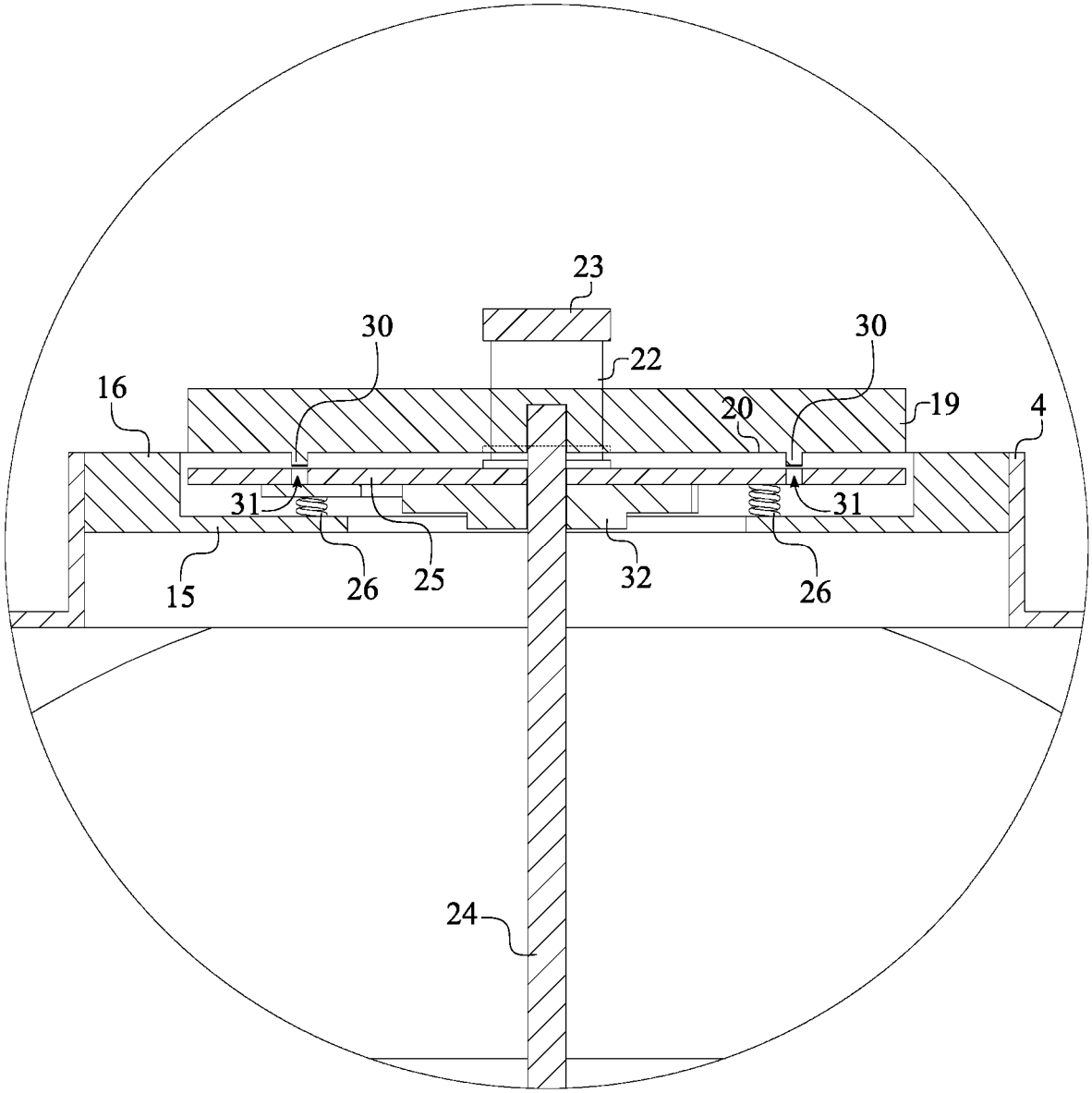
FIG. 11 is a detailed sectional view of the present invention, showing the unlocked position of the locking mechanism.

When the dispensing mechanism 17 is rotatably positioned about the container 1, the locking mechanism 29 is selectively configured into the unlocked position as shown in FIG. 9-11. In reference to the unlocked position, the at least one arm 22 of the handle 21 is positioned offset to the bottom surface 20 of the plate body 19 and pressed against the fluctuating plate 25. The pair of extension legs 30 is positioned external to the pair of openings 31 as the applied pressure of the user compresses the plurality of springs 26 and presses down the fluctuating plate 25 away from the bottom surface 20 of the plate body 19. As a result, the user is able to rotate the top rotor assembly 18 due to the disengagement between the pair of extension legs 30 and the pair of openings 31.

The bottom rotor plate 27 individually selects and dispenses the laundry detergent pods away from the storage compartment 5. In order to accomplish the dispensing of the laundry detergent pods, the present invention further comprises a plurality of openings 28 as shown in FIG. 2-3. More specifically, the plurality of openings 28 traverses through the bottom rotor plate 27 and radially positioned around the central rod 24. The plurality of openings 28 function as individual storage compartments so that each of the plurality of openings 28 is able to receive a single laundry detergent pods from the storage compartment 5 as the dispensing mechanism 17 is rotated. Furthermore, a thickness of the bottom rotor plate 27 is configured to be higher than the general height of the laundry detergent pods thus keeping the entire structure of each laundry detergent pod within each of the plurality of openings 28. Preferably, plurality of openings 28 is equally sized three openings within the present invention.

Figure 5:
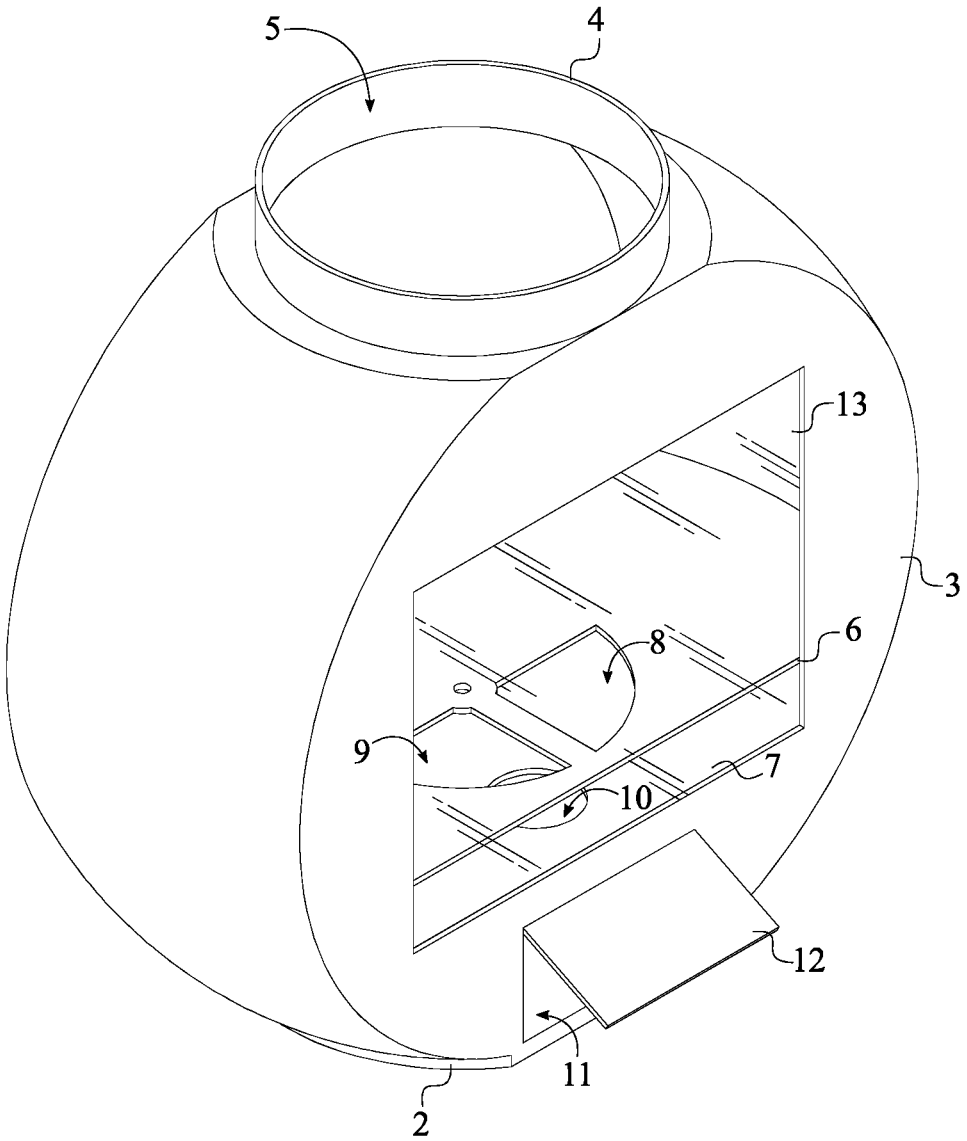
FIG. 5 is a top perspective view of the container of the present invention, wherein the cover is opened.

In reference to FIG. 5, the container 1 further comprises a lateral wall 3, a first separator plate 6, a second separator plate 7, a first opening 8, a second opening 9, a third opening 10, and a dispensing opening 11. More specifically, the lateral wall 3 of the container 1 is connected around the base 2 thus delineating the storage compartment 5 with the base 2 and the lateral wall 3 of the container 1. The rim 4 is connected to the lateral wall 3 of the container 1 and positioned opposite of the base 2 so that the storage compartment 5 can be accessed through the rim 4. The dispensing opening 11 traverses into the storage compartment 5 through the lateral wall 3 of the container 1 so that the dispensing mechanism 17 is able to discharge the laundry detergent pod from the storage compartment 5. In order to properly select and discharge the laundry detergent pods from the storage compartment 5, the configuration of the first separator plate 6 and the second separator plate 7 with respect to the bottom rotor plate 27 is significant within the present invention. More specifically, the first separator plate 6 and the second separator plate 7 are positioned within the storage compartment 5 in such a way that the first separator plate 6 and the second separator plate 7 are positioned adjacent to the base 2. The first separator plate 6 is perimetrically connected to the lateral wall 3 of the container 1 as the first opening 8 and the second opening 9 traverse through the first separator plate 6. The second separator plate 7 is perimetrically connected to the lateral wall 3 of the container 1 as the third opening 10 traverses thought the second separator plate 7. Furthermore, the second separator plate 7 is positioned in between the base 2 and the first separator plate 6 in order to provide proper functionality of the dispensing mechanism 17. The bottom rotor plate 27 is positioned in between the first separator plate 6 and the second separator plate 7 so that the bottom rotor plate 27 is able to continuously discharge a single laundry detergent pod through the dispensing opening 11. Furthermore, the third opening 10 is concentrically positioned in between the first opening 8 and the second opening 9 so that the dispensing mechanism 17 can only release one laundry pod at a time.

In order to discharges the laundry detergent pods within the present invention, the user have to continuously rotate the dispensing mechanism 17 through the top rotor assembly 18. Before the rotating process, two laundry detergent pods are individually positioned atop the first opening 8 and the second opening 9 as a top surface of the bottom rotor plate 27 keeps the both laundry pods within the storage compartment 5. When a first cavity of the plurality of openings 28 concentrically aligns with the first opening 8, the laundry pod that is positioned atop the first opening 8 drops into the first cavity from the storage compartment 5 via the first opening 8. Then, the laundry pod within the first cavity drops into a dispensing compartment of the container 1 through the third opening 10 as the dispensing compartment is positioned in between the base 2 and the second separator plate 7. Consecutively, the first cavity of the plurality of openings 28 is able to pick up another laundry pod through the second opening 9 as the dispensing mechanism 17 is continuously rotated by the user. Simultaneously, a second cavity of the plurality of openings 28 also pick up another laundry pod through the first opening 8 so that the corresponding laundry pod is dropped through the third opening 10 while the laundry pod within the first cavity is retained within the bottom rotor plate 27. Consecutively, the second cavity of the plurality of openings 28 is able to pick up another laundry pod through the second opening 9 as the dispensing mechanism 17 is continuously rotated by the user. Simultaneously, a third cavity of the plurality of openings 28 also pick up another laundry pod through the first opening 8 so that the corresponding laundry pod can be dropped through the third opening 10 while the laundry pods within the first cavity and the second cavity are retained within the bottom rotor plate 27. Consecutively, the present invention is able to repeat the same dispensing cycle to periodically discharge a single laundry detergent pod as long as the user continue to rotate the dispensing mechanism 17.

In reference to FIG. 5, the present invention further comprises a cover 12. More specifically, the cover 12 is hingedly connected to the lateral wall 3 of the container 1 and encloses the dispensing opening 11. As a result, once the laundry detergent pod is dropped into the discharge compartment, the laundry detergent pod remains within the discharge compartment until the user opens the cover 12 and remove the laundry detergent pod.

In reference to FIG. 5, the present invention further comprises a window 13. The window 13 is transparent and is integrated into the lateral wall 3 of the container 1. Resultantly, the window 13 is able to provide a clear view of the storage compartment 5, the first separator plate 6, and the second separator plate 7 thus demonstrating the operation of the dispensing mechanism 17. Furthermore, the user can easily view the number of laundry detergent pods within the storage compartment 5 via the window 13 so that the user can refile laundry detergent pods before they run out or buy a new container 1 that is pre-filled with the laundry detergent pods.

In reference to FIG. 2, the present invention further comprises a ratchet gear 32 and a pawl 33. More specifically, the ratchet gear 32 is concentrically connected to the central rod 24 and positioned in between the connector plate 14 and fluctuating plate 25. A fixed end 34 of the pawl 33 is terminally connected to the connector plate 14 so that a free end 35 of the pawl 33 can be compressionally engaged with the ratchet gear 32. The engagement between the pawl 33 and the ratchet gear 32 are able to rotate the dispensing mechanism 17 in one direction. For example, depending on the configuration of the ratchet gear 32 and pawl 33, the dispensing mechanism 17 can be either rotated in clockwise direction or counterclockwise direction. As a result, the present invention is able to eliminate the laundry detergent pods from getting trapped about the first opening 8 or the second opening 9. Furthermore, uni-directional rotation of the dispensing mechanism 17 is able to continuously discharge the laundry detergent pods as each of the plurality of openings 28 is able to continuously receive a single laundry detergent pod.

Although the invention has been explained in relation to its preferred embodiment, it is to be understood that many other possible modifications and variations can be made without departing from the spirit and scope of the invention as hereinafter claimed.

What is claimed is:

1. A laundry detergent pod dispensing container comprising:

a container;

a connector plate;

a dispensing mechanism;

a locking mechanism;

the dispensing mechanism comprising a top rotor assembly, a central rod, a fluctuating plate, a plurality of springs, and a bottom rotor plate;

the connector plate being circumferencely attached to a rim of the container;

the central rod concentrically traversing through the connector plate;

the top rotor assembly being terminally attached to the central rod;

the top rotor assembly being positioned adjacent to connector plate;

the fluctuating plate being concentrically connected to the connector plate by the plurality of springs;

the fluctuating plate being positioned in between the top rotor assembly and the connector plate;

the locking mechanism being integrated between the top rotor assembly and the fluctuating plate;

the bottom rotor plate being terminally connected to the central rod, opposite of the top rotor assembly; and the bottom rotor plate being positioned adjacent to a base of the container.

2. The laundry detergent pod dispensing container as claimed in claim 1 comprising:

the connector plate comprising an annular base and a lateral wall;

the lateral wall being perimetrically connected around the annular base; and the lateral wall being circumferencely attached to the rim of the container.

3. The laundry detergent pod dispensing container as claimed in claim 2, wherein the annular base being encircled around the central rod.

4. The laundry detergent pod dispensing container as claimed in claim 1 comprising:

the top rotor assembly comprising a plate body and a handle;

the plate body being concentrically positioned within a lateral wall of the connector plate;

the central rod being concentrically attached to the plate body;

at least one arm of the handle being slidably traversing through the plate body;

a main body of the handle being positioned external to the plate body; and the main body of the handle and the central rod being oppositely positioned of each other about the plate body.

5. The laundry detergent pod dispensing container as claimed in claim 1 comprising:

the plurality of springs being compressionally positioned in between the fluctuating plate and an annular base of the connector plate;

the plurality of springs being radially positioned around the central rod; and the plurality of springs being terminally connected to the fluctuating plate and the annular base.

6. The laundry detergent pod dispensing container as claimed in claim 1 comprising:

the locking mechanism comprising a pair of extension legs and a pair of openings;

the pair of extension legs being terminally connected to a plate body of the top rotor assembly;

the pair of extension legs being oriented toward the fluctuating plate; and the pair of openings traversing through the fluctuating plate.

7. The laundry detergent pod dispensing container as claimed in claim 6 comprising:

the dispensing mechanism being positioned stationary about the container, wherein the locking mechanism is selectively configured into a locked position;

the top rotor assembly comprising a plate body and a handle;

at least one arm of the handle being positioned flush to a bottom surface of the plate body;

the plate body being positioned adjacent to the fluctuating plate; and the pair of extension legs being engaged within the pair of openings.

8. The laundry detergent pod dispensing container as claimed in claim 6 comprising:

the dispensing mechanism being rotatably positioned about the container, wherein the locking mechanism is selectively configured into an unlocked position;

the top rotor assembly comprising a plate body and a handle;

the at least one arm being pressed against the fluctuating plate; and the pair of extension legs being positioned external to the pair of openings.

9. The laundry detergent pod dispensing container as claimed in claim 1 comprising:

a plurality of openings;

the plurality of openings traversing through the bottom rotor plate; and the plurality of openings being radially positioned around the central rod.

10. The laundry detergent pod dispensing container as claimed in claim 1 comprising:

the container further comprising a lateral wall, a storage compartment, a first separator plate, a second separator plate, a first opening, a second opening, a third opening, and a dispensing opening;

the lateral wall being connected around the base;

the storage compartment being delineated by the base and the lateral wall;

the rim being connected to the lateral wall, opposite of the base;

the dispensing opening traversing into the storage compartment through the lateral wall;

the first separator plate and the second separator plate being positioned within the storage compartment;

the first separator plate and the second separator plate being positioned adjacent to the base;

the first separator plate being perimetrically connected to the lateral wall;

the first opening and the second opening traversing through the first separator plate;

the second separator plate being perimetrically connected to the lateral wall;

the third opening traversing through the second separator plate; and the bottom rotor plate being positioned in between the first separator plate and the second separator plate.

11. The laundry detergent pod dispensing container as claimed in claim 10 comprising:

a cover;

the cover being hingedly connected to the lateral wall; and the dispensing opening being enclosed by the cover.

12. The laundry detergent pod dispensing container as claimed in claim 1 comprising:

a window; and the window being integrated into a lateral wall of the container.

13. The laundry detergent pod dispensing container as claimed in claim 12, wherein the window is transparent.

14. The laundry detergent pod dispensing container as claimed in claim 1 comprising:

a ratchet gear;

a pawl;

the ratchet gear being concentrically connected to the central rod;

the ratchet gear being positioned in between the connector plate and fluctuating plate;

a fixed end of the pawl being terminally connected to the connector plate; and a free end of the pawl being compressionally engaged with the ratchet gear.

* * * * *